US007244048B2

(12) United States Patent
Poggi

(10) Patent No.: US 7,244,048 B2
(45) Date of Patent: Jul. 17, 2007

(54) UNDERWATER POOL LIGHT

(75) Inventor: Brian Poggi, Hamilton (GB)

(73) Assignee: Aqua Pharos International Limited, East Kilbride (GB)

( * ) Notice: Subject to any disclaimer, the term of this patent is extended or adjusted under 35 U.S.C. 154(b) by 0 days.

(21) Appl. No.: 10/536,484

(22) PCT Filed: Dec. 4, 2003

(86) PCT No.: PCT/GB03/05305

§ 371 (c)(1),
(2), (4) Date: May 24, 2005

(87) PCT Pub. No.: WO2004/053387

PCT Pub. Date: Jun. 24, 2004

(65) Prior Publication Data

US 2006/0072323 A1 Apr. 6, 2006

(30) Foreign Application Priority Data

Dec. 10, 2002 (GB) ..... 0228712.6

(51) Int. Cl.
*F21V 31/00* (2006.01)

(52) U.S. Cl. ..... 362/267; 362/374

(58) Field of Classification Search ..... 362/267, 362/477, 547, 645, 374; 439/205
See application file for complete search history.

(56) References Cited

U.S. PATENT DOCUMENTS 3,962,675 A * 6/1976 Rowley et al. ..... 362/101
4,433,366 A * 2/1984 Wade ..... 362/267
4,574,337 A 3/1986 Poppenheimer ..... 362/267
4,996,635 A 2/1991 Olsson et al. ..... 362/267
5,386,355 A 1/1995 Acks ..... 362/267
5,556,188 A * 9/1996 Poppenheimer ..... 362/101
5,800,041 A * 9/1998 Poggi ..... 362/101
6,152,571 A * 11/2000 Ruiz ..... 362/101
6,184,628 B1 * 2/2001 Ruthenberg ..... 315/185 R
6,203,173 B1 * 3/2001 Duff et al. ..... 362/268
6,241,361 B1 * 6/2001 Thrasher et al. ..... 362/101

FOREIGN PATENT DOCUMENTS

DE 29715580 10/1998
EP 1083384 3/2001

* cited by examiner

*Primary Examiner*—Alan Cariaso
*Assistant Examiner*—Leah Lovell
(74) *Attorney, Agent, or Firm*—Drinker Biddle & Reath LLP

(57) ABSTRACT

An underwater pool light comprises: a housing; a lens sealingly fixed to the housing; a light source located within the housing; and mounting means for mounting the housing to a niche within or on a wall of a pool. The housing includes an integral connector for external connection to an electrical supply cable, and the pool light includes electrical connection means within the housing connecting the light source to the integral connector.

33 Claims, 12 Drawing Sheets

UNDERWATER POOL LIGHT

This Application is the U.S. National Phase Application of PCT International Application No PCT/GB2003/005305 filed Dec. 10, 2003.

The present invention relates to an underwater pool light. In particular, but not exclusively, the invention relates to disposable underwater pool lights for use in swimming pools and spa baths, hereafter referred to as "pools".

DESCRIPTION OF THE RELATED ART

Pools are conventionally built in one of four manners. The first method is to provide two spaced shutters formed from wood or steel, with steel reinforcing bars arranged between the shutters. Apertures are provided at a number of locations in one of the shutters and a niche for the pool light is located in each of the apertures. Typically, the niche is positioned such that a gap exists between the shutter and a flange member provided on the niche. Typically, conventional niches have to be modified so that they are fixed to the shutter by fastening, usually by screwing, a portion of the niche to the shutter. For steel shutters, which are typically hired from a supplier, the cost of repairing or replacing the shutter is incurred.

Cement is poured between the shutters and allowed to set and then the shutters are removed. Finishers are then applied to the cement wall, including between the cement wall and flange of the niche. The finishers comprise render, adhesive and tiling, and the thickness of the finishers can range from 5 to 45 millimetres. It is a difficult task, given this variation in thickness, for the pool builder to ensure that the finishers are flush against the flange member of the niche.

Another method of building the pool is to provide only one shutter and the reinforcing bars. The niches are suspended in position and concrete is sprayed onto the shutter, and around the niches, to form the concrete wall. The same problem exists for the pool builder when applying the finishers to ensure they are flush with the flange member of each niche.

A third method of building the pool is to clamp the lining of a flexible enclosure between two structural layers, typically made of metal, polymer or fibreglass. The two layers also clamp the flange member of each niche and apertures are cut into the material at each niche. A fourth method is to form a fibreglass enclosure in which apertures are cut for receiving each niche which is fastened to the fibreglass wall at the niche flange.

Conventional pool lights do not offer a means for adjusting the distance from visible parts of the pool light, such as the flange member, to the wall of the pool to accommodate variation in thickness of the finishers. Furthermore, no pool light presently exists which can be fitted to each of the four types of pools described above without modification by the pool builder.

Conventional pool lights use one or more separate replaceable bulbs in a housing. Electrical power is supplied via an insulated cable which enters the housing from the niche via an aperture. The aperture includes a permanent seal in order to prevent water entering the housing.

The housing is cooled by the water present in the space between the niche and the housing and also by the water in contact with the lens at the front of the housing. However, there is limited ability for water to flow within the niche. This can cause the accumulation of body fat from swimmers, which can be a health hazard as it encourages the growth of bacteria such as legionella.

When it is necessary to replace the bulb, or carry out any other maintenance to the unit, the housing must be removed from the niche and lifted out of the water. Typically the bulb has a life of around 250 to 1,000 hours of use. Removal of the housing typically requires the removal of a number of screws, which is a difficult task to carry out underwater, due to a lack of visibility and mobility. The cable is typically of sufficient length between the niche and the housing to allow the maintenance to be carried out at the side of the pool.

An improved type of pool light would comprise a modular unit which includes a bulb in a cavity which is enclosed by a permanently sealed body. When replacement of a bulb for such a unit is necessary the entire unit is replaced. This type of pool light would therefore be disposable. Such a type of pool light would require a wet mateable electrical connection between the pool light and the power cable provided in the niche. Also, fittings would be required to prevent any maintenance or bulb replacement from being attempted.

Conventional pool lights do not provide this wet mateable connection or suitable fittings. Such pool lights typically include male connectors which permit electrical arcing if the pool light is connected to the power cable underwater. Also, the male connectors often include a guide pin which is easily damaged.

It is desirable that light from the pool light can project from the side wall and across at least half the width of a standard training pool, as well as achieving illumination of the bottom of the pool. In a typical swimming pool, an individual pool light may be required to illuminate an area having a length of 6 metres from the unit, a width of 4 metres (2 metres either side of the unit) and a depth of 2.4 metres from the unit to the base of the pool. It is undesirable and inefficient for the projected light to be projected upwards relative to the base of the pool.

Conventional pool lights use a three dimensional parabola shaped reflector to reflect light that is projected from the bulb in a direction towards the rear of the housing. Conventional lens and reflector arrangements are not adapted to direct the radiation of light so that there is a greater proportion of radiation in a downwards direction. Also, the angle of illumination, in the plane of the base of the pool, is limited. Conventional lamps do not significantly hinder the radiation of light in an upwards direction. Dark regions can be present in the pool near to the junction of the base and side walls and at the side walls where the pool lights are situated.

BRIEF SUMMARY OF THE INVENTION

According to the present invention, there is provided an underwater pool light comprising:

- a housing;
- a light source located within the housing:
- a lens sealingly connected to the housing by a plurality of fasteners; and
- a guard member adapted to prevent unfastening of at least one of the plurality of fasteners such that the light source is enclosed within a permanently sealed body.

Preferably the pool light includes mounting means for mounting the housing to a niche within or on a wall of a pool.

Preferably the housing includes an integral connector for external connection to an electrical supply cable, and the pool light includes electrical connection means within the housing connecting the light source to the integral connector.

Preferably the pool light includes a niche for mounting the housing within or on the wall of a pool.

Preferably the connector is wet mateable.

Preferably the connector includes a cable receiving recess, and the recess has a keyed portion which is complementary to a keyed portion provided at the cable. Preferably the cable receiving recess is formed by a flange projecting from the housing.

Preferably the connector comprises one or more pins projecting externally from the housing and adapted to engage with one or more corresponding sockets on the cable. Preferably the pins project into the recess. Preferably a portion of each pin is encased in the housing.

Preferably the connector further comprises one or more sleeves projecting externally from the housing and at least partially surrounding the one or more pins. The sleeves may be formed integrally with the housing. Preferably the or each sleeve is made of plastic or rubber.

Preferably the mounting means comprises a component of the housing adapted to slideably engage with a component of the niche, such that the distance between the housing and the niche is selectively adjustable. Preferably the pool light includes clamping means for clamping the component of the housing relative to the component of the niche.

Preferably the mounting means is adapted such that the distance between the housing and the niche is infinitely adjustable over the adjustment length.

Preferably the component of the housing comprises one or more protrusions provided at the housing and the component of the niche comprises one or more slots provided at the niche. Preferably three protrusions and three slots are provided. Preferably the or each protrusion includes a keyed portion which is complementary in profile to the profile of the slot.

Preferably the clamping means comprises at least one screw fastener.

Preferably the the component of the housing is provided at lens holding member.

Preferably the housing includes a collar projecting from a face of the housing. Preferably the collar has a projecting length of around 50 millimetres. The collar provides an edge up to which a pool builder may apply finishers to the pool wall. The collar may then be trimmed.

Preferably the housing includes one or more cam receiving slots, and the lens includes one or more cammed members for pivotally locating the lens relative to the lens holding member. Preferably two cammed members are provided.

Preferably the lens includes fastener locating means and a fastener for fastening the lens to the lens holding member. Preferably the fastener locating means comprises a hollow coned protrusion for aligning the lens to a fastener receiving aperture provided at the lens holding member. The cammed members and fastener locating means allow self alignment of the lens to the lens holding member.

Preferably the housing includes a lamp enclosure which is sealably connected to the lens by a plurality of fasteners. Preferably the housing includes a trim guard which covers the fasteners to prevent unfastening of the fasteners. Preferably the trim guard includes a plurality of pegs which are received in apertures provided at the lens. The trim guard prevents removal of the lens for replacement of the bulb or other maintenance of the pool light.

Preferably the housing includes two or more openings for allowing the flow of water into and out of the niche. Preferably the openings are provided at the perimeter of the lens. Preferably the openings comprise a number of cut-outs or castellations provided at the perimeter of the lens.

Preferably the niche includes one or more brackets for receiving one or more fastening rods, such as screwed rod. Preferably the or each bracket is adapted to receive one or more fastening rods of a plurality of sizes. Preferably the or each bracket is adapted to receive fastening rods oriented vertically, horizontally, or obliquely relative to the base of the pool.

Preferably the lens has a first portion adapted to direct light substantially normal to the wall of the pool, and a second portion adapted to direct light substantially parallel to the wall of the pool, and wherein the pool light further comprises:

a reflector located within the housing and having a first portion which is substantially parabolic in vertical cross section and a second portion which is adapted to reflect light substantially towards the second portion of the lens.

Preferably the second portion of the lens is provided at the internal surface of the lens. Preferably the second portion of the lens comprises a plurality of Fresnel members adapted to direct light substantially parallel to the wall of the pool. Preferably each Fresnel member includes an edge adapted to bend light so that it is substantially parallel to the wall of the pool. The second portion of the lens may be adapted to cause diffraction of light in a direction substantially parallel to the wall of the pool. The second portion of the lens may include a reflective surface to reflect light in a direction substantially parallel to the wall of the pool.

Preferably each Fresnel member is arcuate and substantially concentric about the light source. Preferably the second portion of the lens is adapted to direct light downwards. Preferably the second portion of the lens is further adapted to direct light substantially horizontally in each direction.

Preferably the first portion of the reflector is substantially linear in horizontal cross section.

Preferably the second portion of the reflector has a planar surface oriented to reflect light substantially towards the second portion of the lens. Preferably the second portion of the reflector is provided at an upper region of the reflector.

Preferably the reflector includes a third portion which is adapted to reflect light substantially towards the second portion of the lens. Preferably the third portion of the reflector has a planar surface. Preferably the third portion of the reflector is provided at each side of the reflector.

Preferably the pool light further comprises a shading member adapted to inhibit the radiation of light in at least one direction. Preferably the shading member is adapted to inhibit the radiation of light in an upwards direction.

Preferably the shading member is positioned at the external surface of the lens. Alternatively the shading member is positioned at the internal surface of the lens. Preferably the shading member is press fit to the lens or housing.

Preferably the shading member is positioned at an upper portion of the lens relative to the base of the pool. Preferably the shading member is substantially oval.

BRIEF DESCRIPTION OF THE DRAWINGS

An embodiment of the present invention will now be described, by way of example only, with reference to the accompanying drawings, in which.

DETAILED DESCRIPTION OF THE INVENTION

Figure 1:
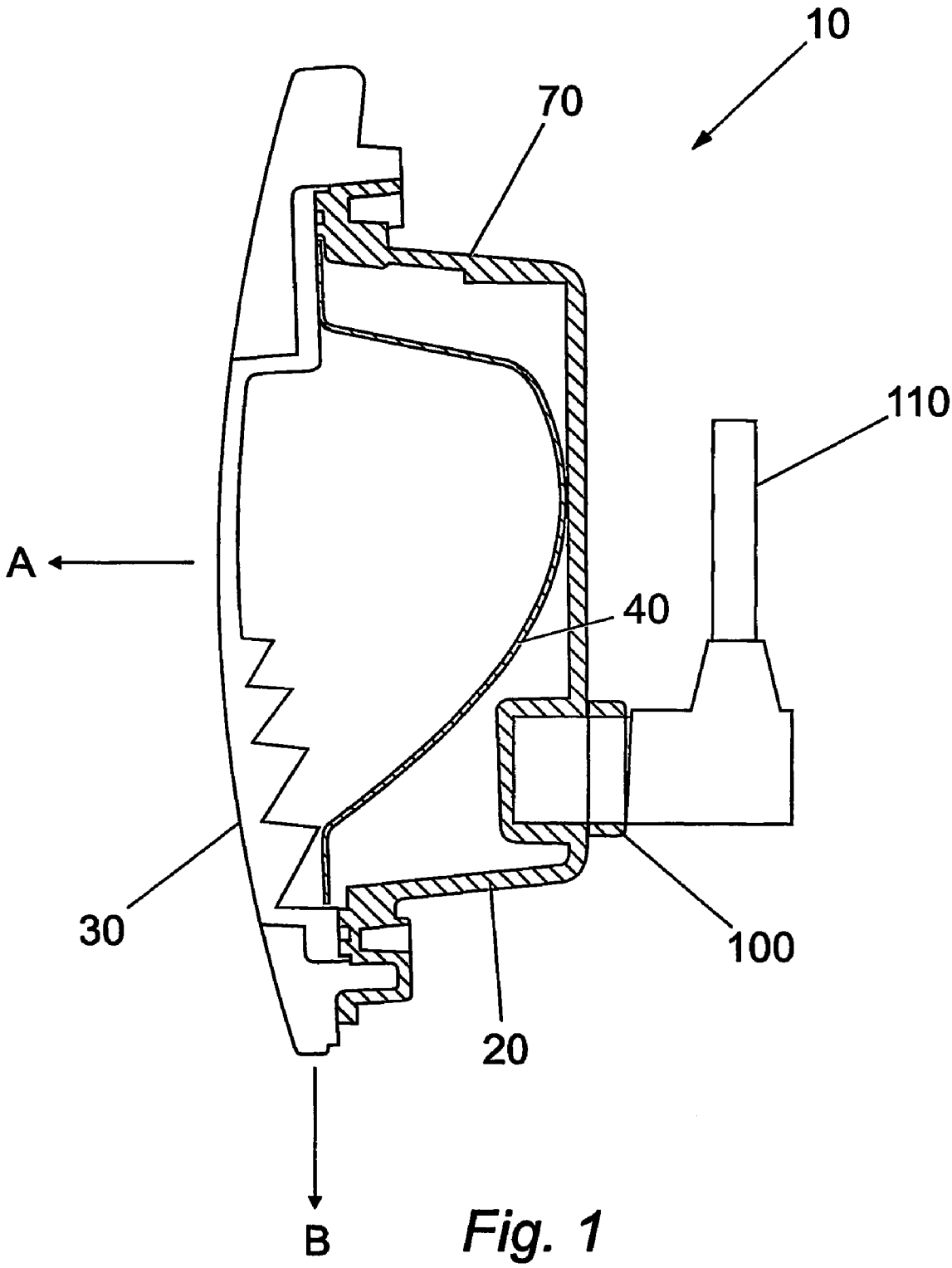
FIG. 1 is a side view of a pool light.
Figure 3:
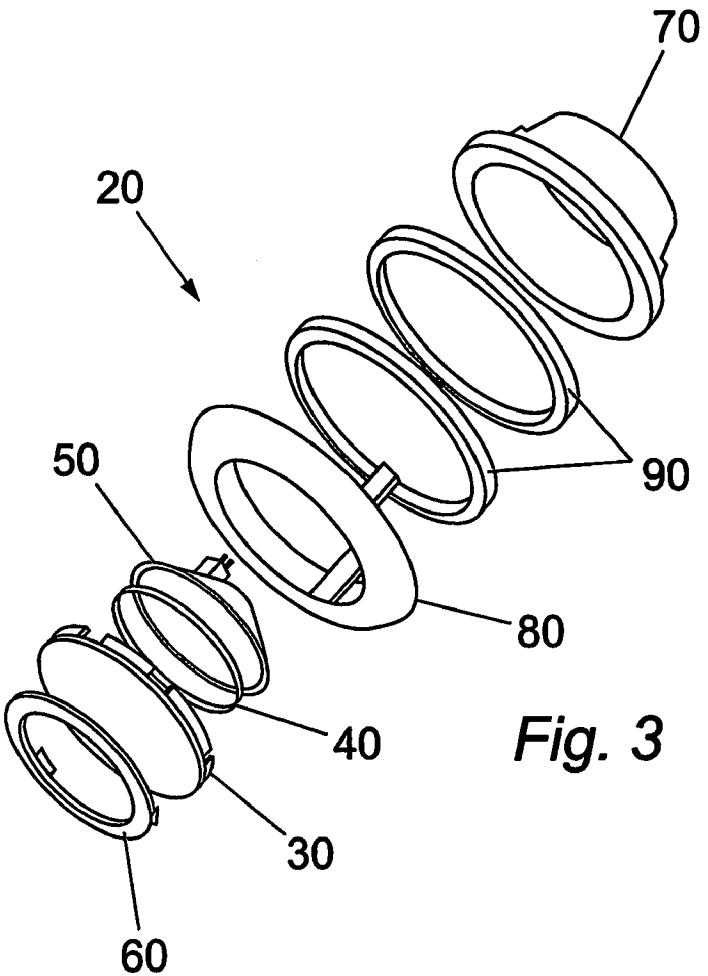
FIG. 3 is a perspective exploded view of the pool light of FIG. 1.
Figure 2:
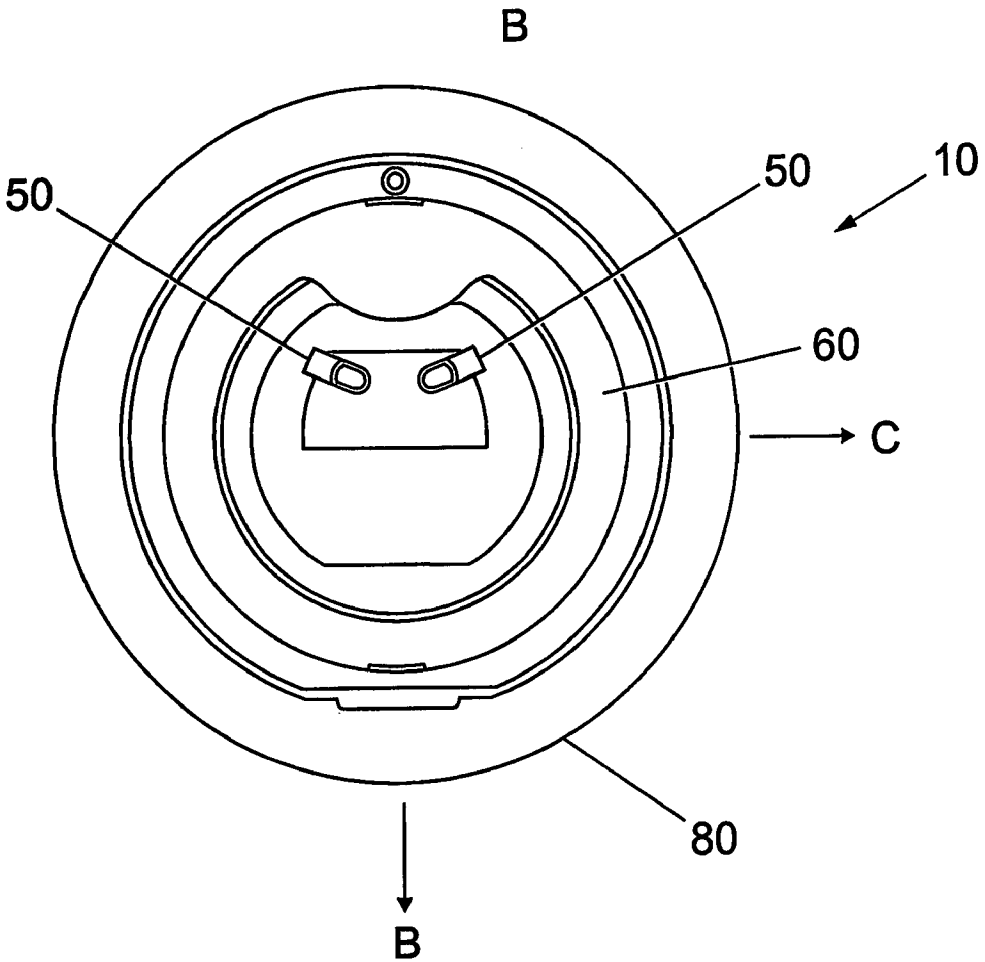
FIG. 2 is a front view of the pool light of FIG. 1.

Referring to FIGS. 1 to 3 there is shown a pool light 10 comprising a housing 20 which has a opening that is covered by a lens 30. A reflector 40 and a light source in the form of two bulbs 50 are housed within the housing 20. A trim guard 60 is fitted to the lens 30.

The housing includes a lamp enclosure 70 and lens holding member, or bezel 80, which is sealably connected to the lamp enclosure 70 using a number of gaskets 90.

A collar (not shown) may be provided as projecting from the inner circumference of the lamp enclosure 70. This collar, typically of 50 millimetres length, provides an edge up to which a pool builder may apply finishers to the pool wall. Once the finishers had been applied, the collar may then be trimmed so that its projecting edge is flush with the pool wall.

The lamp enclosure 70 includes an electrical connector 100 for connection to a power supply cable 110. Internal wiring (not shown) connects the connector 100 to the two bulbs 50.

Figure 5:
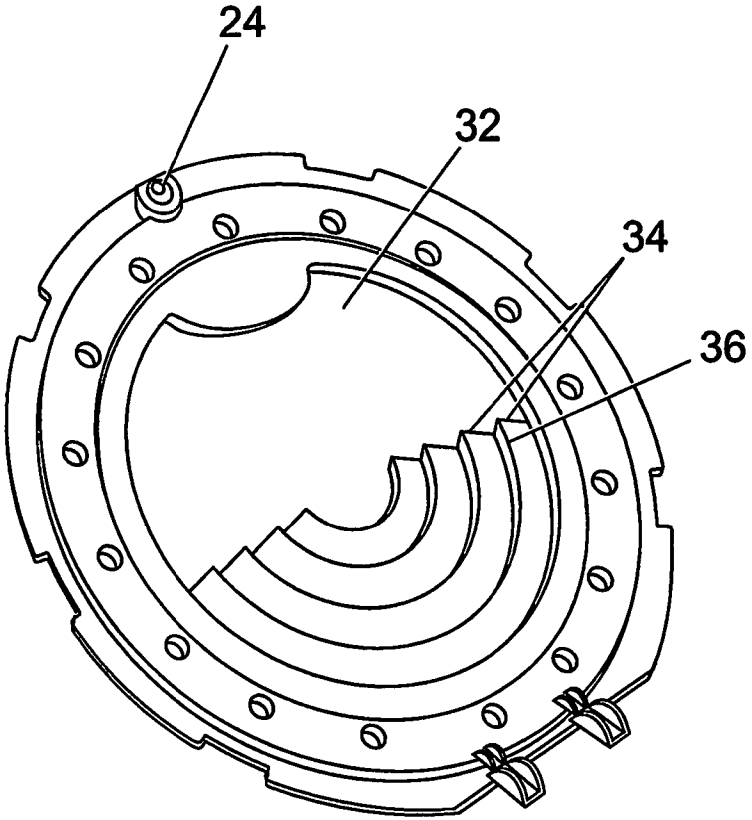
FIG. 5 is a perspective rear view of the lens of FIG. 4.

FIG. 5 is a rear view of the lens 30. The lens has a first portion 32 adapted to direct light in a direction substantially normal to the wall in which the pool light 10 is fitted. This direction is shown in FIG. 1 and is denoted as direction 'A'. The lens 30 also has a second portion which comprises a number of Fresnel members 34 which are adapted to direct light substantially parallel to the wall of the pool. This direction may be downwards which is shown in FIGS. 1 and 2 as direction 'B'. The direction of light from the Fresnel members 34 may also be horizontal which is shown in FIG. 2 as direction 'C'. The direction of light may also be at an oblique angle lying anywhere between directions 'B' and 'C'. The Fresnel members 34 are all provided within a lower region of lens 30, and are arcuate and concentric about the bulbs 50. Each Fresnel member 34 includes an edge 36 which is adapted to bend light so that it is parallel to the pool wall.

Figure 7:
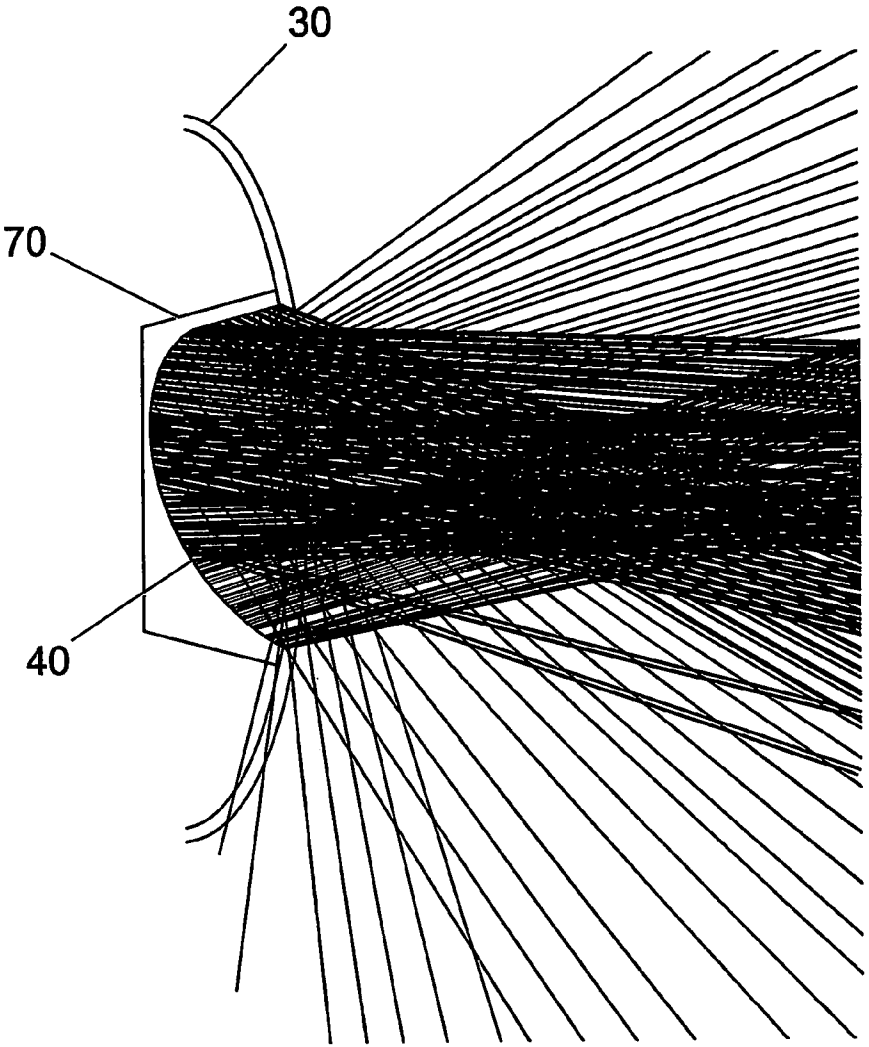
FIG. 7 is the diagrammatic view of FIG. 6 showing the radiation of light.
Figure 6:
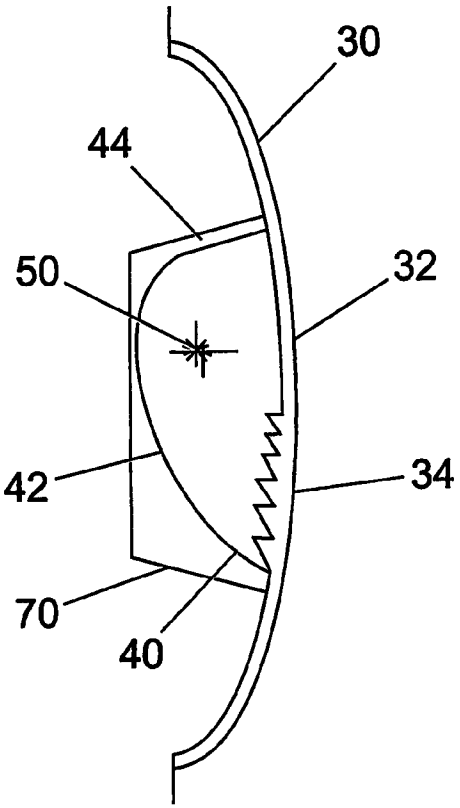
FIG. 6 is diagrammatic side view of the pool light of FIG. 1.
Figure 9:
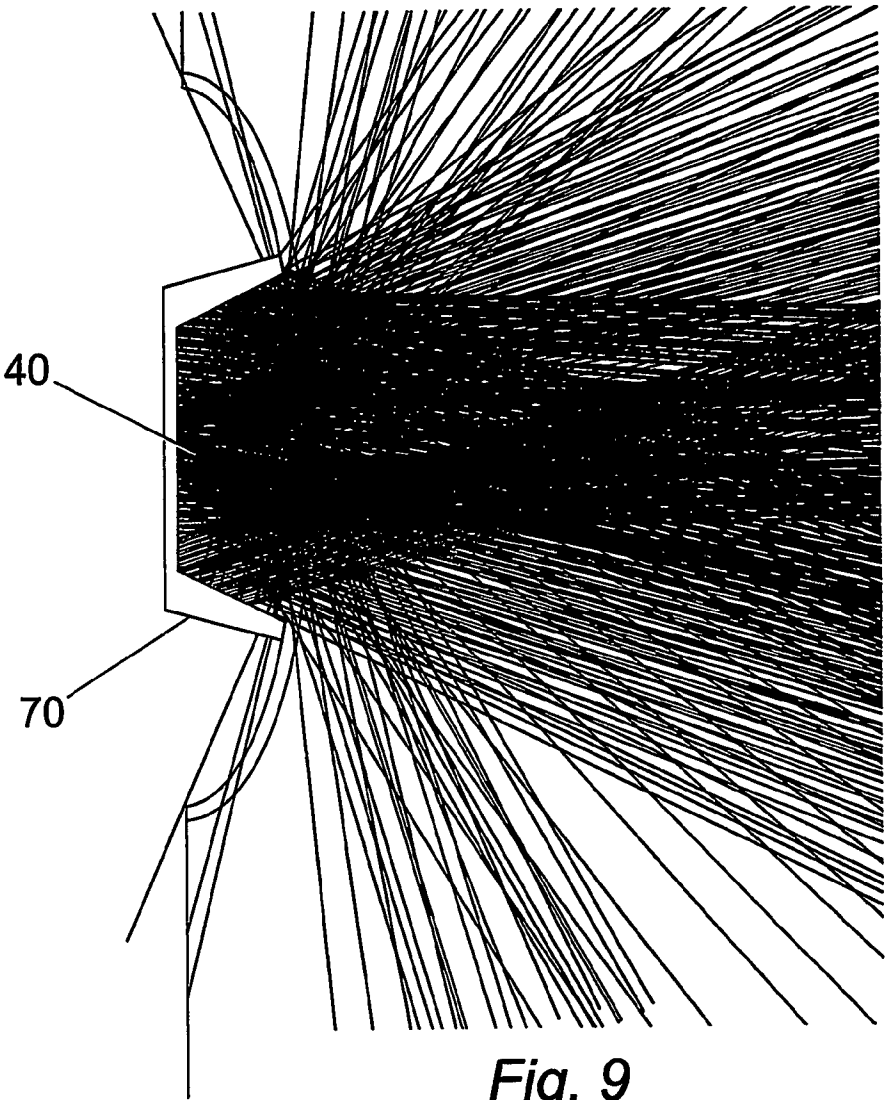
FIG. 9 is the diagrammatic view of FIG. 8 showing the radiation of light.
Figure 10:
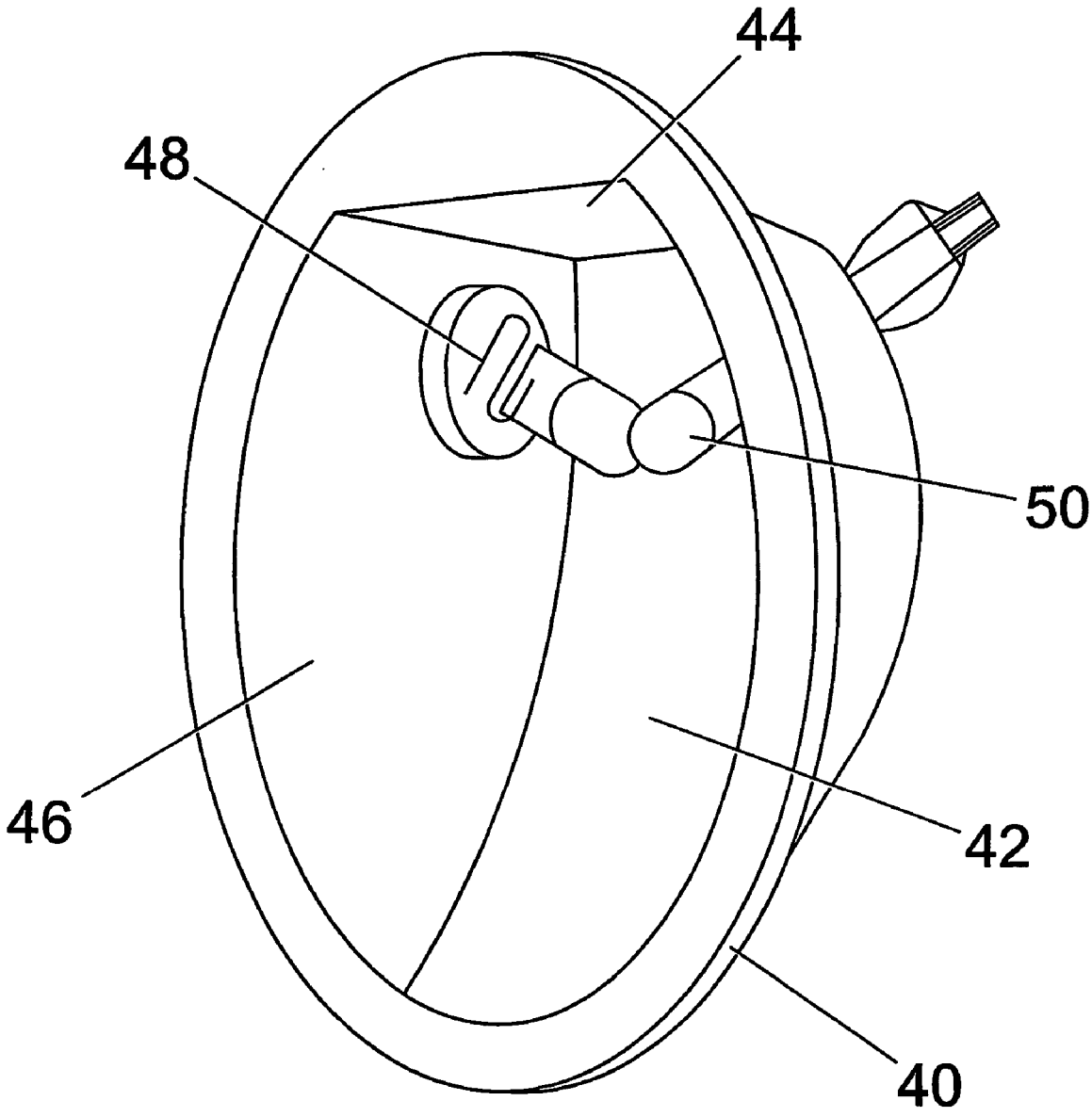
FIG. 10 is a perspective view of a reflector of the pool light of FIG. 1.

Light may reach the lens 30 directly from the bulbs 50 or it may be reflected from the reflector 40. The reflector 40 is shown in FIG. 10, and its sectional profile is shown in FIGS. 6 to 9. The reflector 40 has a first portion 42 which is substantially parabolic in vertical cross section and so reflects light in a direction substantially normal to the pool wall. The reflector 40 also has a second portion 44 which has a planer surface and is oriented to reflect light substantially towards the Fresnel members 34. FIG. 7 shows that a substantial amount of light is radiated in a direction normal to the pool wall. A significant proportion of light is also radiated downwards.

Figure 8:
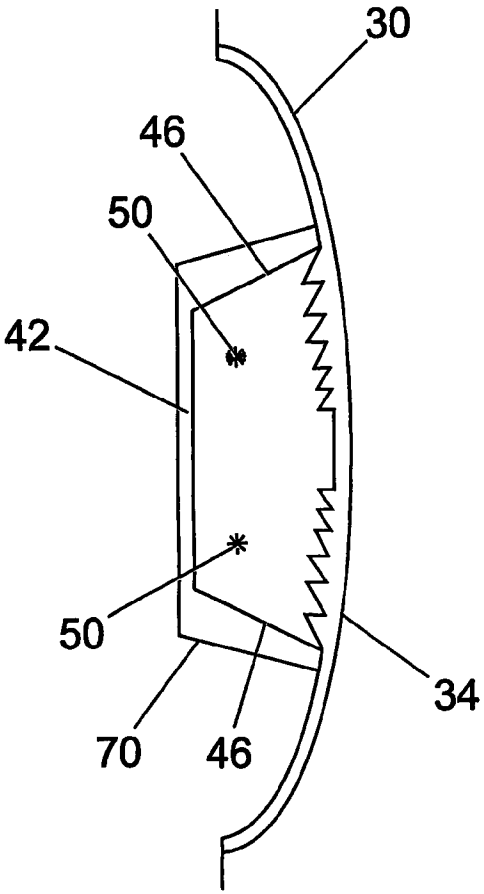
FIG. 8 is a diagrammatic plan view of the pool light of FIG. 1.

As shown in FIG. 8, the first portion of the reflector is linear in horizontal cross section, rather than parabolic. The reflector 40 also includes a third portion 46 which has a planar surface and is oriented to direct light to the Fresnel members 34 so that the light is directed horizontally and parallel to the wall of the pool. The radiation of light can be seen in FIG. 9, and it can be seen that a significant proportion of light is radiated in a substantially horizontal direction.

It is to be understood that the reflector 40 and Fresnel members 34 co-operate to provide a significant portion of light being directed in a direction parallel to the pool wall and that, if either feature were used individually, the effect would not be significant.

The reflector is typically made from aluminium. FIG. 10 shows that an 'S' shape is stamped through the reflector wall at each side at a position near to the bulbs 50. This allows folding of the material within the 'S' shape to produce two legs to hold each bulb 50 while providing an aperture for receiving each bulb 50 and allowing access to electrical wiring.

As seen in FIG. 2, the trim guard 60 includes a shading member 62 positioned at an upper region of the lens 30. The shading member 62 is oval and opaque and so inhibits the radiation of light in an upwards direction.

Figure 4:
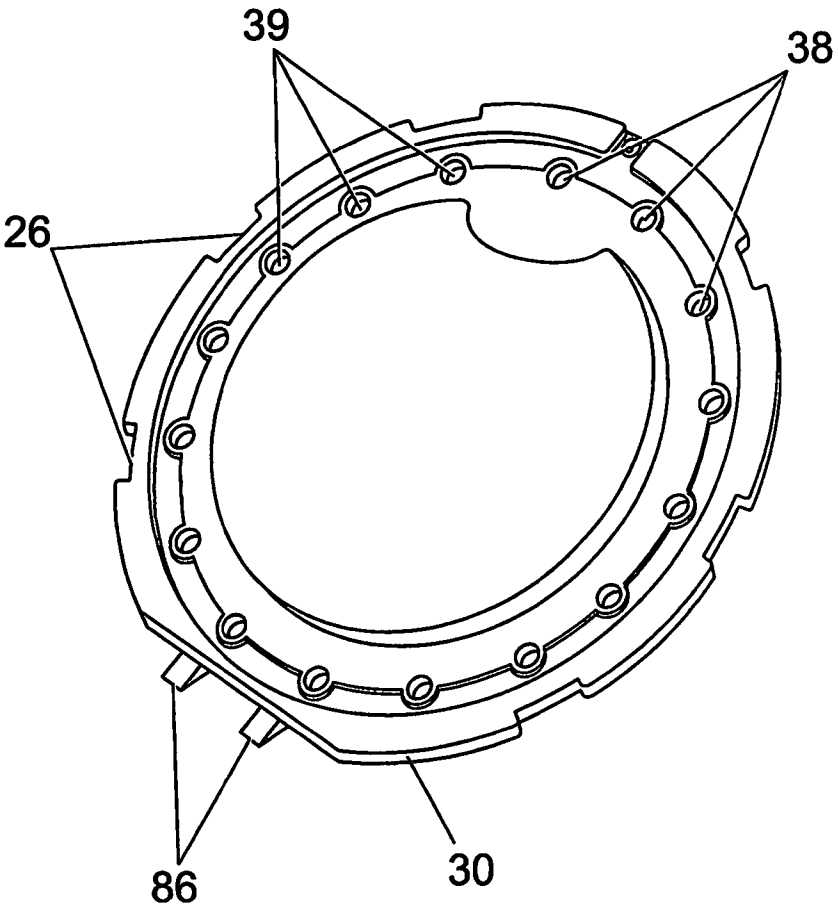
FIG. 4 is a perspective front view of a lens of the pool light of FIG. 1.

Referring to FIG. 4, the trim guard 60 is fitted to the lens 30 using alternate holes 38 provided in the lens 30. The rear of the trim guard 60 includes pegs (not shown) for press fitting into the holes 38. The remaining holes 39 of the lens 30 are used for connection of the lens 32 to the lamp enclosure 70.

Figure 12:
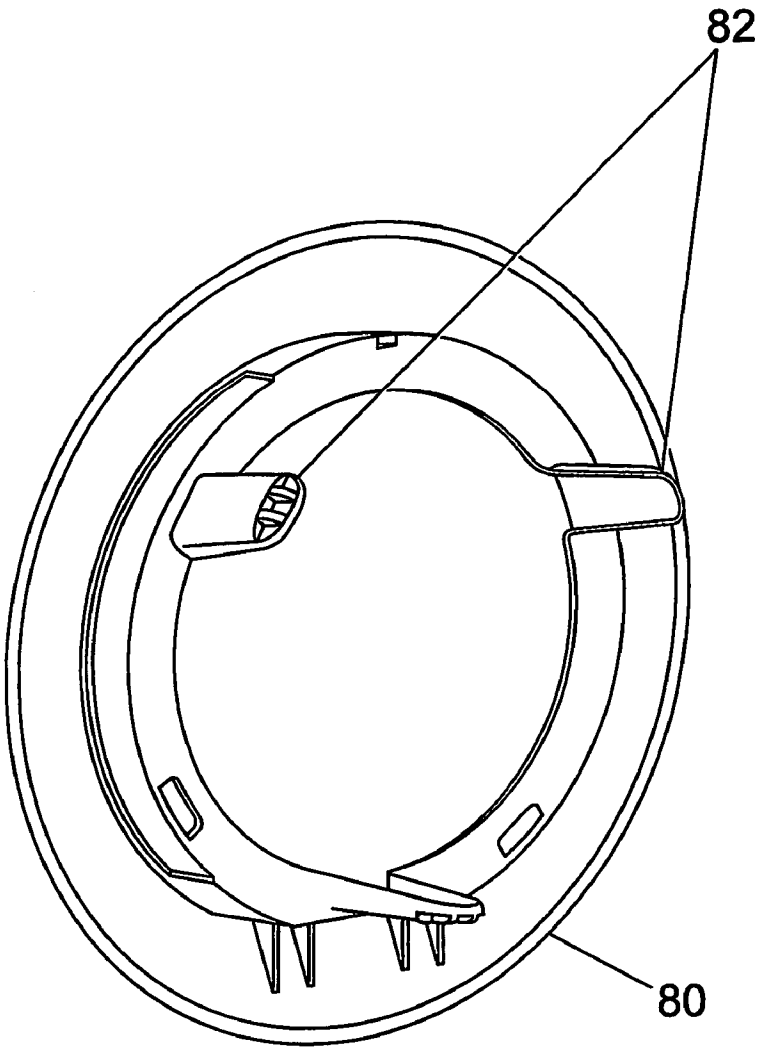
FIG. 12 is a perspective rear view of the bezel of FIG. 11.
Figure 11:
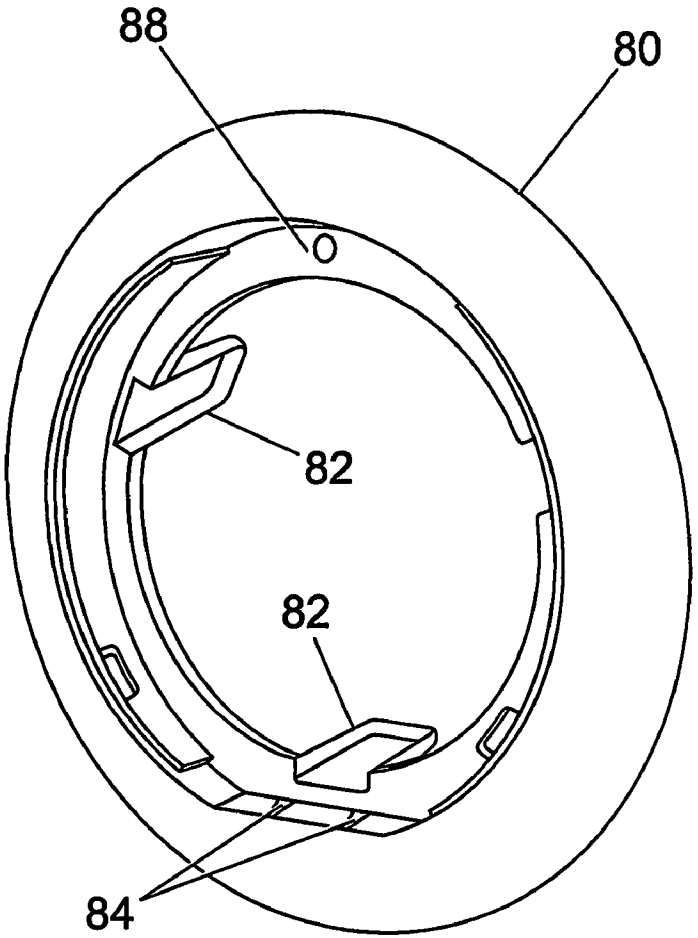
FIG. 11 is a perspective front view of a bezel of the pool light of FIG. 1.
Figure 13:
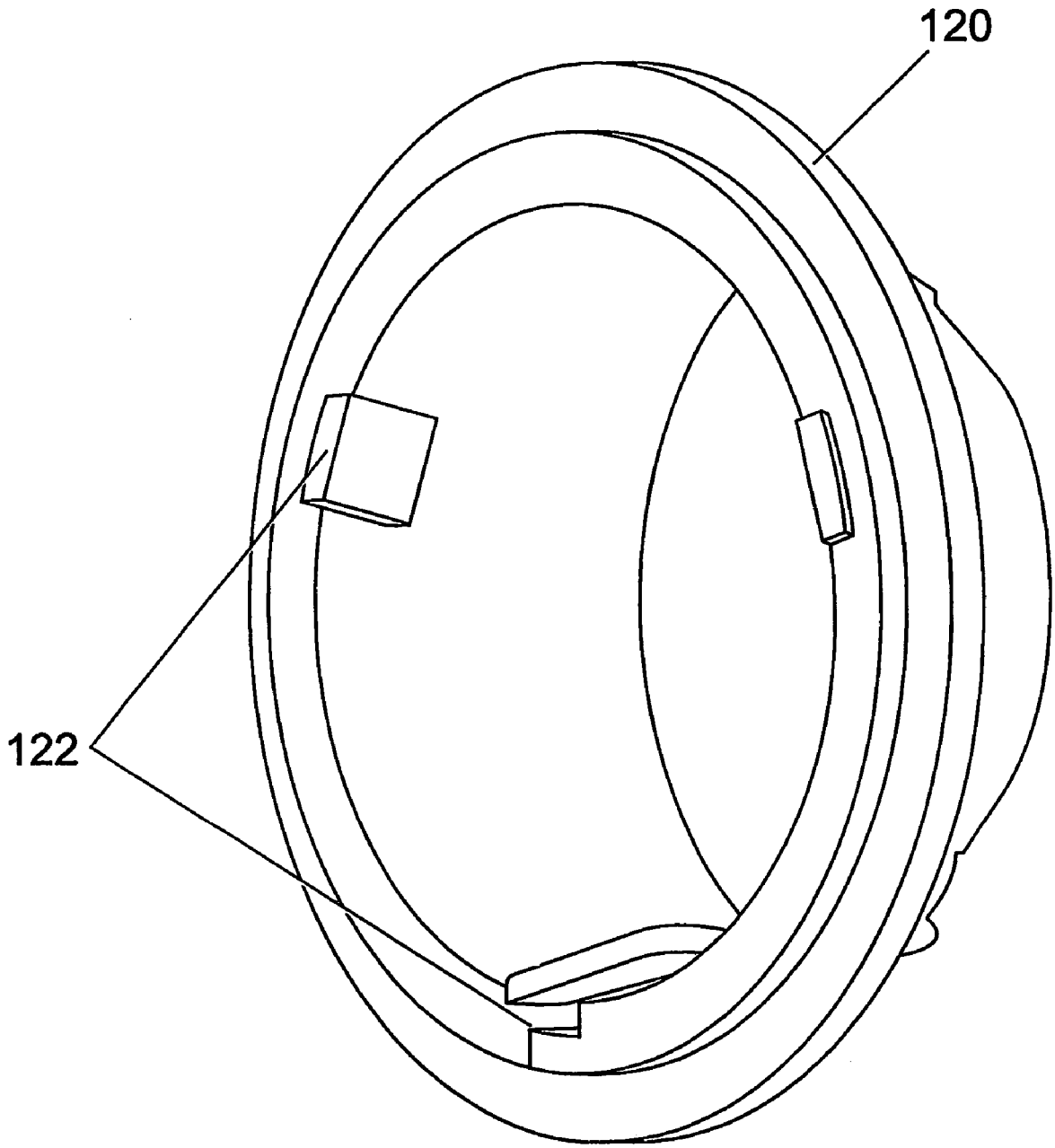
FIG. 13 is perspective front view of a niche of the pool light of FIG. 1.
Figure 14:
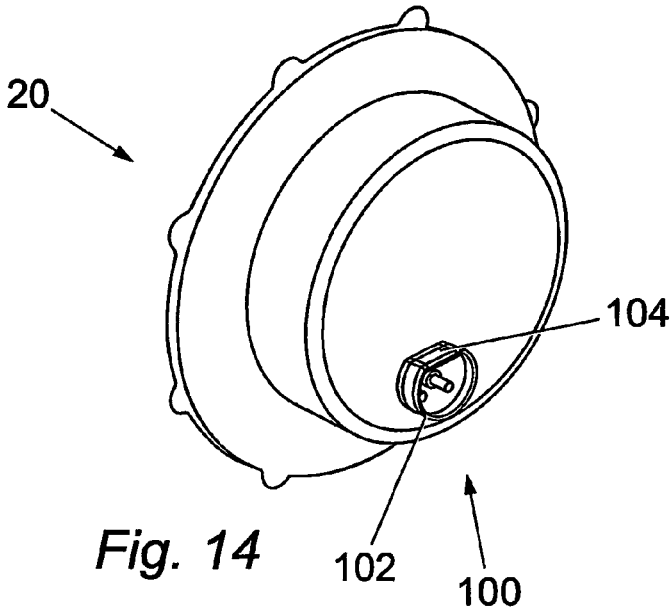
FIG. 14 is a perspective rear view of a housing of the pool light of FIG. 1.
Figure 15:
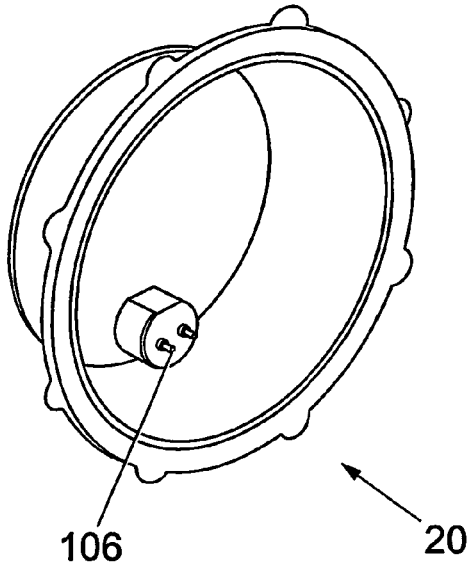
FIG. 15 is a perspective front view of a housing of the pool light of FIG. 1.
Figure 16:
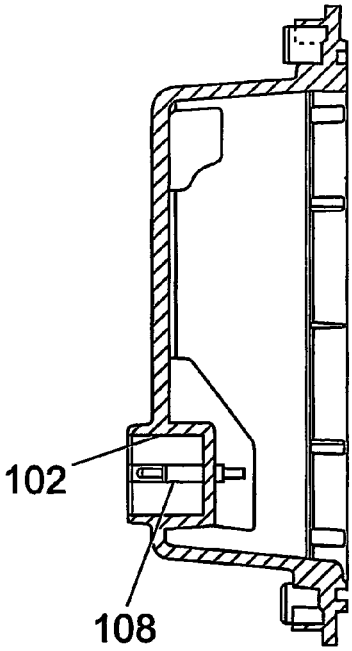
FIG. 16 is a sectional side view of a housing of the pool light of FIG. 1.
Figure 17:
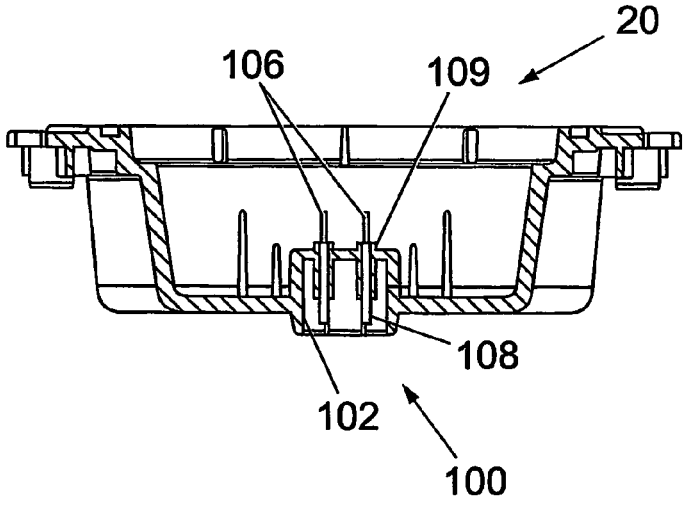
FIG. 17 is a sectional plan view of a housing of the pool light of FIG. 1.

The pool light 10 includes a niche 120 for mounting the pool light 10 within the wall of the pool. Mounting means are provided for mounting the housing 20 to the niche 120. The mounting means comprises a component of the housing, in the form of three protrusions 82 provided at the rear of the bezel 80, which are adapted to slidably engage with a component of the niche, in the form of corresponding slots 122 provided at the niche 120. The bezel 80 and niche 120 are shown in FIGS. 11 to 13. The mounting means allows the distance between the housing 20 and niche 120 to be selectively adjusted. Clamping means, in the form of screw fasteners (not shown) are provided for clamping the protrusions 82 at the selected position in the slots 122.

The bezel 80 includes two cam receiving slots 84 (as shown in FIG. 11) for receiving the cammed members 86 provided at the lens 30 (as shown in FIG. 4). The lens 30 may conveniently be fitted to the bezel 80 by locating the cammed members 86 in the cam receiving slots 84 and pivoting the upper region of the lens 30 towards the bezel 80. The lens 30 includes fastener locating means in the form of a hollow coned protrusion 24 provided at the rear of the lens 30. The coned profile of the protrusion 24 assists to align the protrusion 24 in a fastener receiving aperture 88. A fastener such as a screw (not shown) may be inserted through the coned protrusion 24 and screwed within the aperture 88 to hold the lens 30 to the bezel 80. The cammed members 86, fastener locating means, and the use of only one fastener allow easier aligning and fastening of the lens 30 to the bezel 80.

FIG. 4 shows that the lens 30 includes a number of openings or castellations 26 provided at the perimeter of the lens 30. These castellations 26 allow the flow of water into and out of the niche 120.

Figure 18:
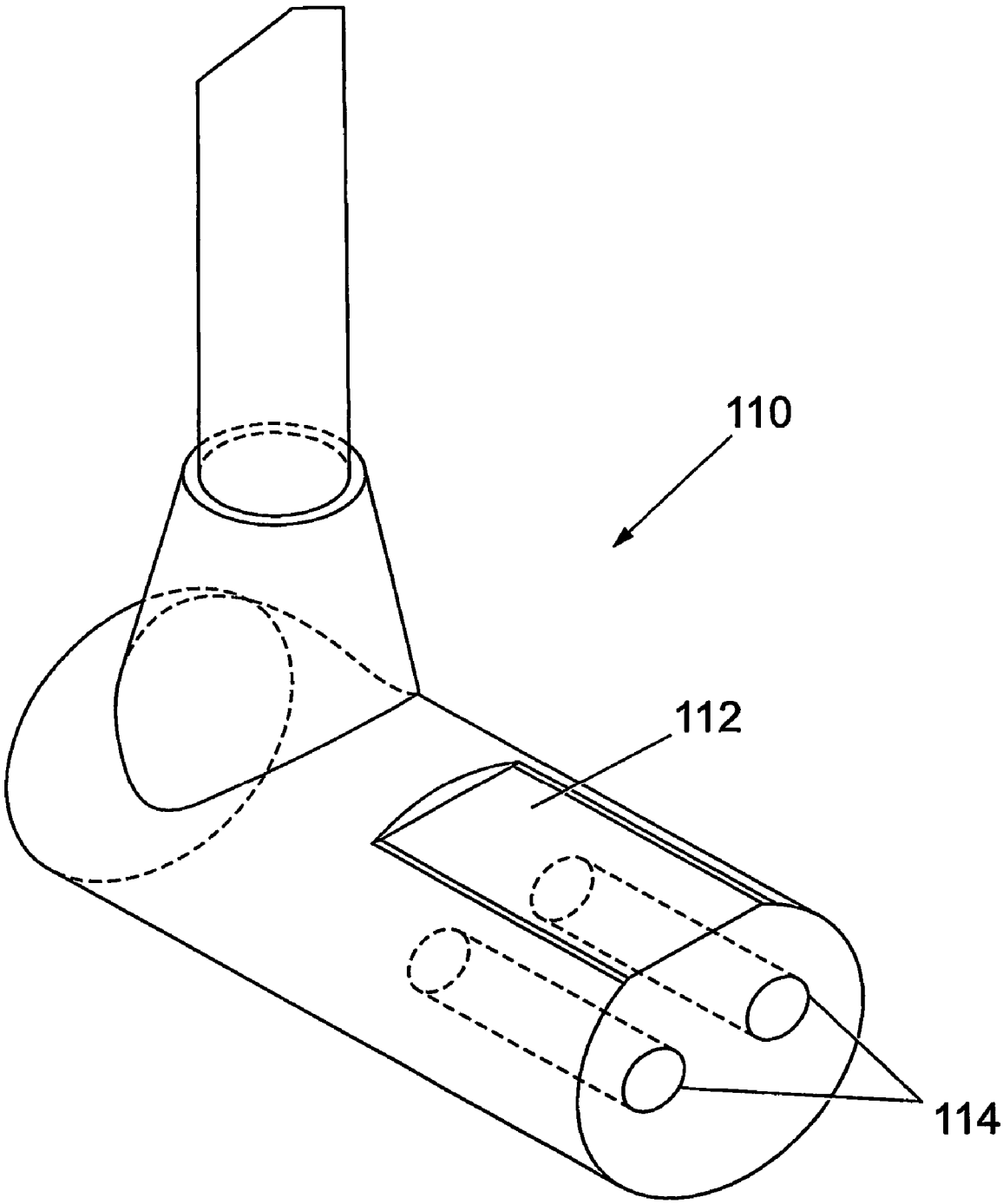
FIG. 18 is a perspective view of a supply cable of the pool light of FIG. 1.

FIGS. 14 to 17 show the electrical connector 100 of the housing 20 for connection to a power supply cable 110, a portion of which is shown in FIG. 18. The connector is wet mateable in the sense that the pool light 10 may be connected to the power cable 110 under water.

The connector 100 includes two terminal pins 106, each partially enclosed by a sleeve 108 formed from an electrically non-conducting material, such as plastic. The pins 106 and sleeves 108 are permanently fixed within apertures 109 provided in the housing 20. Any suitable fixing means can be used providing that water is not able to enter the housing 20 via the apertures. In the illustrated embodiment, the pins 106 and sleeves 108 are moulded into the housing. Wiring (not shown) is used to connect the exposed end of each pin 106 to the bulbs 50.

The supply cable 110 includes two sockets 114 which receive the other end of the pins 106 within the sleeves 108 to form an electrical connection when the pins 106 have been fully received. The close fitting of the sleeves 108 to the sockets 114 causes water to be expelled from the sockets 114. The other end of the cable 110 is permanently fixed to a second connector 130 provided at one of two cable entry ports 132 provided in the niche 120. A further supply cable (not shown) connects the second connector 130 to the power supply.

The connector 100 includes a cable receiving recess 102. This recess 102 includes a keyed portion 104 which is complementary to a keyed portion 112 of the cable 110. These keyed portions 104, 112 permit insertion of the cable 110 into the recess 102 in one orientation only, thereby ensuring correct insertion of the cable 110.

Figure 19:
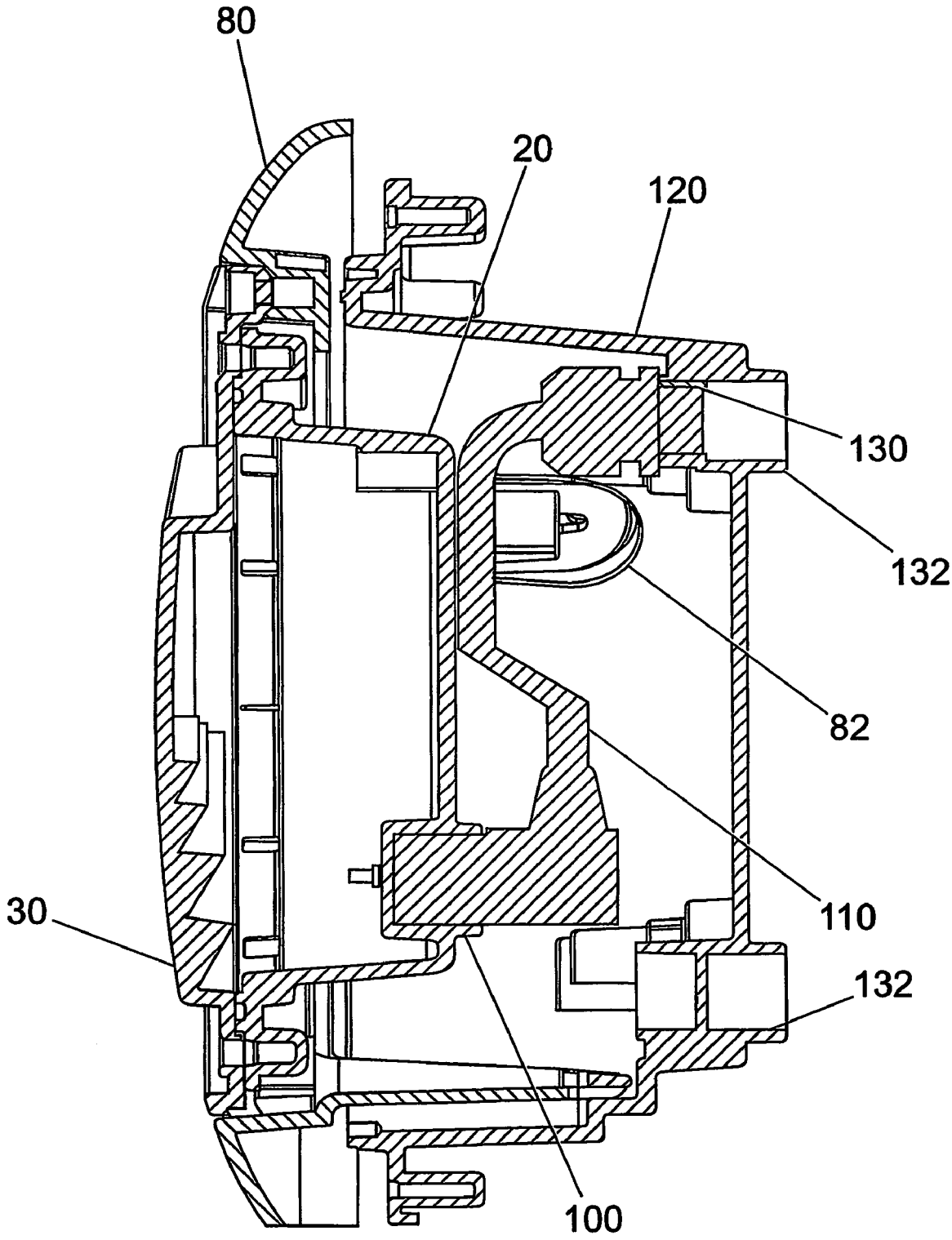
FIG. 19 is a sectional side view of the pool light of FIG. 1.

FIG. 19 shows the pool light 10 within the niche 120. The pool light 10 can be removed a short distance from the niche 120 and then disconnected from the supply cable 110 while still underwater. Therefore, only a short length of cable 110 need be accommodated between the housing 20 and niche 120. The L shape of one end of the cable 110 also assists in accommodating the cable 110.

Figure 20:
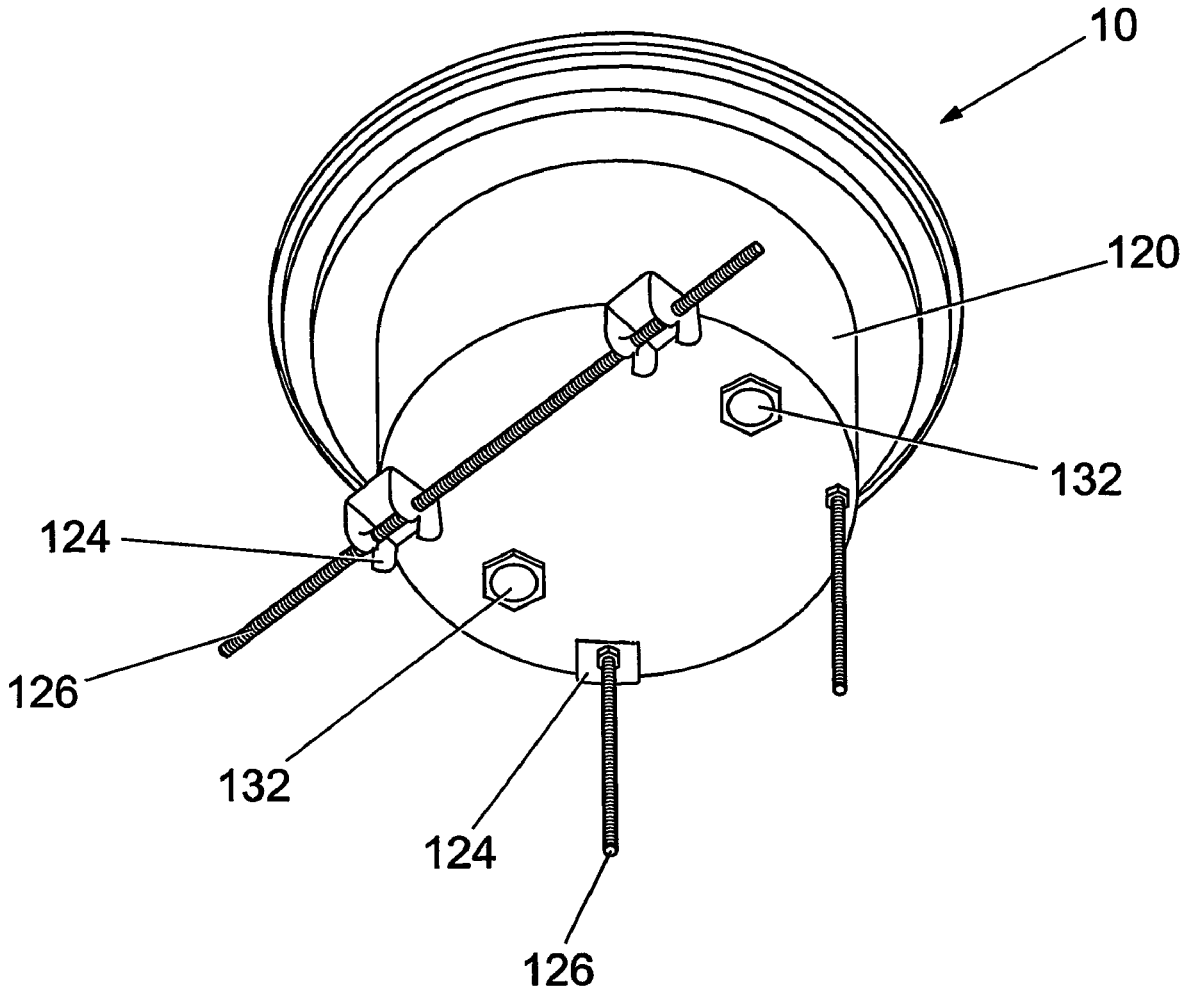
FIG. 20 is a perspective rear view of the niche of FIG. 13.

FIG. 20 shows that the niche 120 includes a number of brackets 124 for receiving fastening rods, such as screwed rod 126. The screwed rod 126 is typically of the standard size such as M6 or M8, and the brackets are adapted to receive more than one size of screwed rod 126. The brackets 124 are adapted to receive screwed rod 126 which is vertically or horizontally oriented. This allows the vertical position of the pool light 10 to be set during installation.

The present invention may be used for any of the four methods of pool building without any further modification.

Various modifications and improvements can be made without departing from the scope of the present invention.

The invention claimed is:

1. A non-maintainable underwater pool light comprising:

a housing locatable within a niche;

a light source located within the housing;

a lens sealingly connected to the housing by a plurality of fasteners; and a guard member adapted to prevent unfastening of at least one of the plurality of fasteners by covering the fasteners so that the fasteners are not easily accessible when the pool light is removed from the niche and when the pool light is located within the niche such that the light source is enclosed within a permanently sealed body.

2. An underwater pool light as claimed in claim 1, wherein the guard member includes a plurality of protrusions which are receivable in apertures provided at the lens.

3. An underwater pool light as claimed in claim 1, wherein the housing includes an integral connector for external connection to an electrical supply cable, and the pool light includes electrical connection means within the housing connecting the light source to the integral connector.

4. An underwater pool light as claimed in claim 3, wherein the connector is wet mateable.

5. An underwater pool light as claimed in claim 3, wherein the connector includes a cable receiving recess, and wherein the recess has a keyed portion which is complementary to a keyed portion provided at the cable.

6. An underwater pool light as claimed in claim 3, wherein the connector comprises at least two pins projecting externally from the housing and adapted to engage with at least two corresponding sockets on the cable.

7. An underwater pool light as claimed in claim 6, wherein the connector further comprises at least two sleeves projecting externally from the housing and at least partially surrounding the at least two pins.

8. An underwater pool light as claimed in claim 7, wherein each sleeve is made of plastic.

9. An underwater pool light as claimed in claim 7, wherein each sleeve is integral with the housing.

10. An underwater pool light as claimed in claim 1, including a niche and mounting means for mounting the housing to the niche.

11. An underwater pool light as claimed in claim 10, wherein the mounting means comprises a component of the housing adapted to slideably engage with a component of the niche, such that the distance between the housing and the niche is selectively adjustable.

12. An underwater pool light as claimed in claim 11, further including clamping means for clamping the component of the housing relative to the component of the niche.

13. An underwater pool light as claimed in claim 12, wherein the clamping means comprises at least one screw fastener.

14. An underwater pool light as claimed in claim 11, wherein the mounting means is adapted such that the distance between the housing and the niche is infinitely adjustable over the adjustment length.

15. An underwater pool light as claimed in claim 11, wherein the component of the housing comprises at least one protrusion provided at the housing and the component of the niche comprises at least one slot provided at the niche.

16. An underwater pool light as claimed in claim 11, wherein the component of the housing is provided at a lens holding member.

17. An underwater pool light as claimed in claim 16, wherein the housing includes at least one cam receiving slot, and wherein the lens includes at least one cammed member for pivotally locating the lens relative to the lens holding member.

18. An underwater pool light as claimed in claim 16, wherein the lens includes fastener locating means and a fastener for fastening the lens to the lens holding member.

19. An underwater pool light as claimed in claim 18, wherein the fastener locating means comprises a hollow coned protrusion for aligning the lens to a fastener receiving aperture provided at the lens holding member.

20. An underwater pool light as claimed in claim 10, wherein the housing includes a collar projecting from a face of the housing.

21. An underwater pool light as claimed in claim 10, including at least two openings for allowing the flow of water into and out of the niche.

22. An underwater pool light as claimed in claim 21, wherein the openings comprise a number of castellations provided at the perimeter of the lens.

23. An underwater pool light as claimed in claim 10, wherein the niche includes at least one bracket for receiving at least one fastening rod.

24. An underwater pool light as claimed in claim 23, wherein each bracket is adapted to receive at least one fastening rod of a plurality of sizes.

25. An underwater pool light as claimed in claim 23, wherein each bracket is adapted to receive fastening rods oriented vertically relative to the base of the pool.

26. An underwater pool light as claimed in claim 23, wherein each bracket is adapted to receive fastening rods oriented horizontally relative to the base of the pool.

27. An underwater pool light as claimed in claim 23, wherein each bracket is adapted to receive fastening rods oriented obliquely relative to the base of the pool.

28. An underwater pool light as claimed in claim 1, wherein the lens has a first portion adapted to direct light substantially normal to the wall of the pool, and a second portion adapted to direct light substantially parallel to the wall of the pool, and wherein the pool light further comprises:

a reflector located within the housing and having a first portion which is substantially parabolic in vertical cross section and a second portion which is adapted to reflect light substantially towards the second portion of the lens.

29. An underwater pool light as claimed in claim 28, wherein the second portion of the lens is provided at the internal surface of the lens.

30. An underwater pool light as claimed in claim 28, wherein the second portion of the lens comprises a plurality of Fresnel members adapted to direct light substantially parallel to the wall of the pool.

31. An underwater pool light as claimed in claim 30, wherein each Fresnel member is arcuate and substantially concentric about the light source.

32. An underwater pool light as claimed in claim 28, wherein the reflector includes a third portion which is adapted to reflect light substantially towards the second portion of the lens.

33. An underwater pool light as claimed in claim 28, further comprising a shading member adapted to inhibit the radiation of light in at least one direction.

* * * * *